US007506993B2

(12) United States Patent
Kain et al.

(10) Patent No.: US 7,506,993 B2
(45) Date of Patent: Mar. 24, 2009

(54) FLUORESCENT BULB RETAINING SPRING

(75) Inventors: Burkhard Kain, Lüdenscheid (DE); Hans-Peter Mews, Lüdenscheid (DE)

(73) Assignee: Vossloh-Schwabe Deutschland GmbH, Ludenscheid (DE)

( * ) Notice: Subject to any disclaimer, the term of this patent is extended or adjusted under 35 U.S.C. 154(b) by 329 days.

(21) Appl. No.: 11/116,335

(22) Filed: Apr. 28, 2005

(65) Prior Publication Data

US 2005/0248937 A1 Nov. 10, 2005

(30) Foreign Application Priority Data

May 4, 2004 (DE) ..... 10 2004 021 938

(51) Int. Cl.
*F21S 4/00* (2006.01)

(52) U.S. Cl. ..... 362/217; 362/219; 362/260; 362/382; 362/396; 439/241; 248/50

(58) Field of Classification Search ..... 362/217, 362/260, 382, 614, 219, 396; 439/241; 248/50
See application file for complete search history.

(56) References Cited

U.S. PATENT DOCUMENTS 2,247,117 A * 6/1941 De Reamer ..... 439/241
2,271,836 A * 2/1942 Francis ..... 362/344
2,888,657 A * 5/1959 Green ..... 439/242
3,154,252 A * 10/1964 Baake ..... 362/222
6,971,917 B2 * 12/2005 Faust et al. ..... 439/619
2002/0130237 A1 * 9/2002 Kluser ..... 248/316.1
2002/0157235 A1 * 10/2002 Napolitano et al. ..... 29/505

FOREIGN PATENT DOCUMENTS

DE 33 43 080 A1 6/1985
DE 88 05 219 U1 6/1988
DE 43 07 604 A1 9/1994

* cited by examiner

*Primary Examiner*—Stephen F Husar
*Assistant Examiner*—Jessica L McMillan
(74) *Attorney, Agent, or Firm*—Foley & Lardner LLP

(57) ABSTRACT

A fluorescent bulb retaining spring (6) comprises a one piece, sheet-metal stamped and bent part, entirely and seamlessly comprised of one material. The retaining spring (6) can be produced especially simply from one rectangular piece of sheet metal of substantially uniform thickness, with all functional parts and functional regions created by cutting out spring tongues and bending them outwardly from the sheet. Connecting legs between a bulb retainer portion (9) and a fastening portion (8) form an annular region which is closed in force-locking fashion by a crimped connection (29, 31, 32), which can be produced in automated fashion as part of the stamping and bending operation.

20 Claims, 2 Drawing Sheets

FLUORESCENT BULB RETAINING SPRING

CROSS-REFERENCE TO RELATED PATENT APPLICATIONS

The right of foreign priority is claimed under 35 U.S.C. § 119(a) based on Federal Republic of Germany Application No. 10 2004 021 938.9, filed May 4, 2004, the entire contents of which, including the specification, drawings, claims and abstract, are incorporated herein by reference.

BACKGROUND OF THE INVENTION

Fluorescent bulbs with a base or cap on one end, so-called compact fluorescent bulbs, are often quite long. If they have a base on only one end, they cannot readily be mounted in a horizontal position. An additional retaining device is necessary, which braces the end of the discharge tube that is diametrically opposite the base, which for instance is bent into a U, so that bending stresses can be kept away from both the base and the socket of the bulb. Otherwise, such bending stresses could cause considerable damage and attendant complaints.

In the industry, it is known to brace the ends of fluorescent bulbs having a base at one end with a plastic retaining part, which in some embodiments is also provided with a metal spring. However, a UV-resistant plastic must be used for this purpose, because fluorescent bulbs always emit a considerable proportion of UV light, which at least in the immediate vicinity of the bulb puts a corresponding stress on the plastics material.

For retaining elements constructed in multiple parts, which and for instance including a plastic base and a metal spring borne by this base, the same is correspondingly true. Moreover, in production, care must be taken with regard to the connection between the plastic and the retaining spring.

SUMMARY OF THE INVENTION

With this as the point of departure, it is the object of the present invention to create a fluorescent bulb retaining spring which can be produced simply and economically, which is embodied stably and durably, and which is easy to manipulate.

According to one aspect of the present invention, there has been provided a fluorescent bulb retaining spring suitable for supporting the tube portion of a fluorescent bulb that has a base at one end, comprising: a spring body formed integrally of resilient metal and including, a) a fastening portion that comprises a fastening mechanism for attaching the retaining spring to a surface; and b) a bulb retainer portion comprising at least one detent spring tongue and one associated abutment for the fluorescent bulb.

According to another aspect of the invention, there has been provided a method for forming a bulb retaining spring as defined according to claim 1, comprising providing a generally rectangular sheet of metal and subjecting the metal sheet to a stamping and bending process to form said bulb retaining spring.

Further objects, features and advantages of the present invention will become apparent from the detailed description of preferred embodiments that follows, when considered together with the accompanying figures of drawing.

BRIEF DESCRIPTION OF THE DRAWINGS

Exemplary embodiments of the fluorescent bulb retaining spring are shown in the drawings, wherein.

DETAILED DESCRIPTION OF PREFERRED EMBODIMENTS

Figure 3:
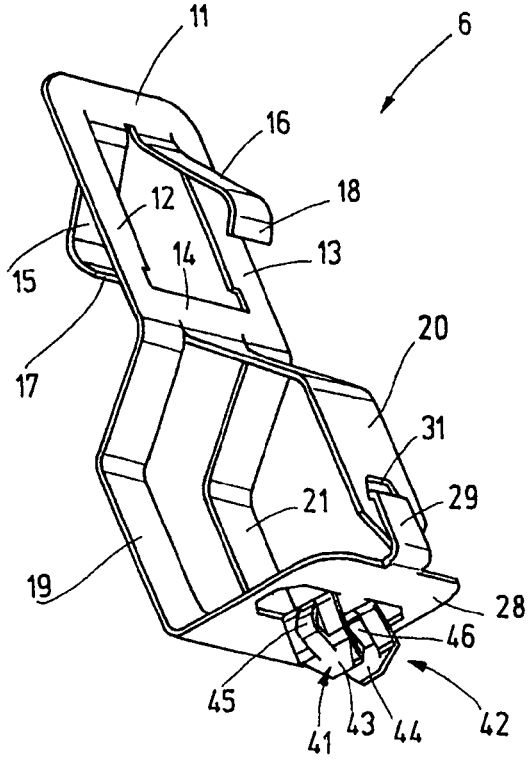
FIG. 3 is a perspective view of a modified embodiment of the retaining spring of the invention.

The fluorescent bulb retaining spring of the invention is embodied in one piece of resilient metal. The one-piece production can be done in a stamping and bending process, so that the retaining springs can be produced in their final form by machine, without requiring subsequent assembly or other subsequent work operations. The retaining spring has a fastening portion and a bulb retainer portion. In this respect, it is shaped in a special way and in its entirety is in one piece. It has no UV-vulnerable parts whatever. Accordingly, even after long use, no plastic parts that could have become brittle can break off. On the contrary, secure seating of the fluorescent bulbs and the relief of both the base and socket of the bulb are assured over a long period of time.

Moreover, the one-piece mode of construction of the fluorescent bulb retaining spring, including all the functional elements, enables not only especially rational production, but also simple, rational installation, or mounting, in a lamp. The fluorescent bulb retaining spring, depending on its embodiment, can be inserted into pre-stamped holes in the lamp housing and locked to them in detent fashion. Another option is for the retaining spring to be fastened by means of a sheet-metal screw, metric screw, or blind rivet.

The fluorescent bulb retaining spring is preferably made from a chromium-nickel steel, which is not vulnerable to heat, UV rays, aging, or corrosion and which does not need to be electroplated in a post-treatment. Moreover, it has the necessary spring properties.

It is considered advantageous if the bulb retainer portion has a flat crosspiece, whose face is oriented substantially perpendicular to the fastening portion and from which two detent spring tongues extend toward the fastening portion at acute angles to one another. In that case, the bulb retainer portion can be thrust between two arms of a discharge tube that is bent into the shape of a U. Because they are positioned at an acute angle, the detent tongues slide easily through the interstice between the arms of the tube. Preferably, the detent spring tongues are bent outwardly to different sides of the bulb retainer portion. Thus the tube and the retaining spring are automatically centered relative to one another.

The detent tongues extend to different sides from the common crosspiece and are preferably retained between two legs that bear the crosspiece. The legs and the crosspiece form a frame inside which the detent tongues are cut free, extending into the opening. The result is a stable construction which is smooth one the side toward the opening in the lamp, that is, toward the user, so that the risks of injury in manipulation are minimized.

For connecting the bulb retainer portion and the fastening portion, connecting legs that spread apart away from one another are preferably provided, which contact diametrically opposed sides of the fastening portion. The connecting legs are preferably embodied with a kink. On the one hand, this makes it possible to embody oblique faces, which serve as abutments or contact faces for the arms of the tube of the fluorescent bulb and, on the other hand, portions of the connecting legs are parallel to one another and act like a parallelogram, and thus are capable of developing a certain lateral resilience. This can be utilized to compensate for tolerances, in order to prevent the fluorescent bulb retaining spring from exerting undesirable forces on the fluorescent bulb.

The fastening can be done by means of detent means, suspension means, or simply through a fastening opening for a fastening screw or a rivet or the like. In all cases, the plate-like portion assures secure seating of the retaining spring on a corresponding flat contact face, which for instance is part of a lamp housing or shade.

Figure 1:
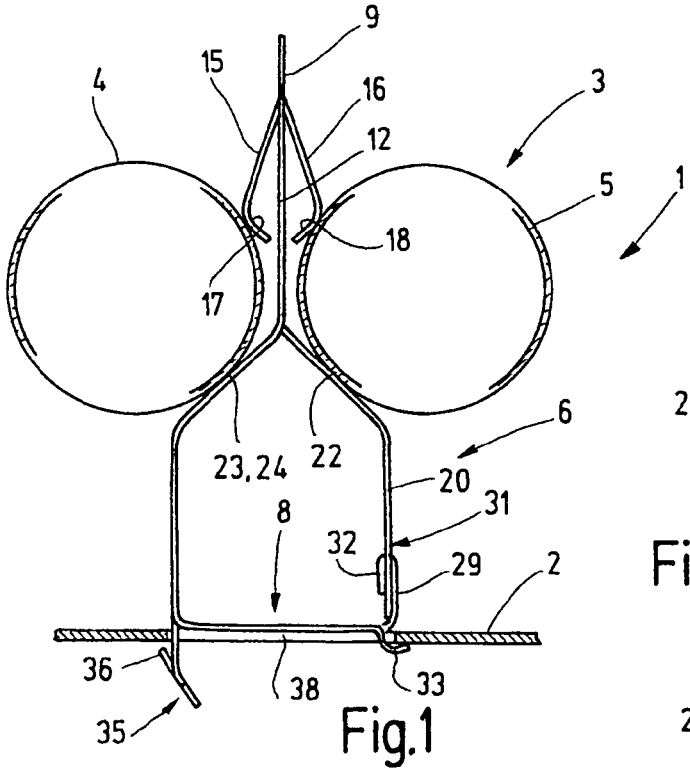
FIG. 1 is a partial cross-sectional view showing a fluorescent bulb retaining spring of a first embodiment, in use for fastening a schematically represented fluorescent bulb that has a base at one end.

Referring now to the drawings, in FIG. 1, a detail of a lamp 1 is shown, which includes among other elements a lamp housing 2 and a fluorescent bulb 3. The fluorescent bulb has a discharge tube that is bent into a U-shape and the arms 4, 5 of which are parallel to one another and spaced slightly apart from one another. The discharge tube is mounted on a base located at one end. The base and the associated socket are not shown in further detail in FIG. 1. At a greater spacing from the base, preferably approximately in the vicinity of the end of the discharge tube where the arms 4, 5 are joined together, a retaining spring 6 is provided, which supports the otherwise freely floating end of the fluorescent bulb 3 on the lamp housing 2. This is applicable to either a horizontal mounting of the fluorescent bulb 3, as shown in FIG. 1, or a suspension mounting, as could be imagined with FIG. 1 turned upside-down, or a horizontal mounting with a lateral lamp housing of the kind that can be imagined by rotating FIG. 1 by 90°. With a vertically disposed fluorescent bulb 3 as well, the retaining spring 6 can be employed, in order to secure the fluorescent bulb 3 in the vertical position. This may be advantageous, particularly when swiveling bulb sockets are used. The retaining spring 6 is embodied such that, in all the mounted positions named, it performs a supporting function of the fluorescent bulb 3 on the lamp housing 2.

Figure 2:
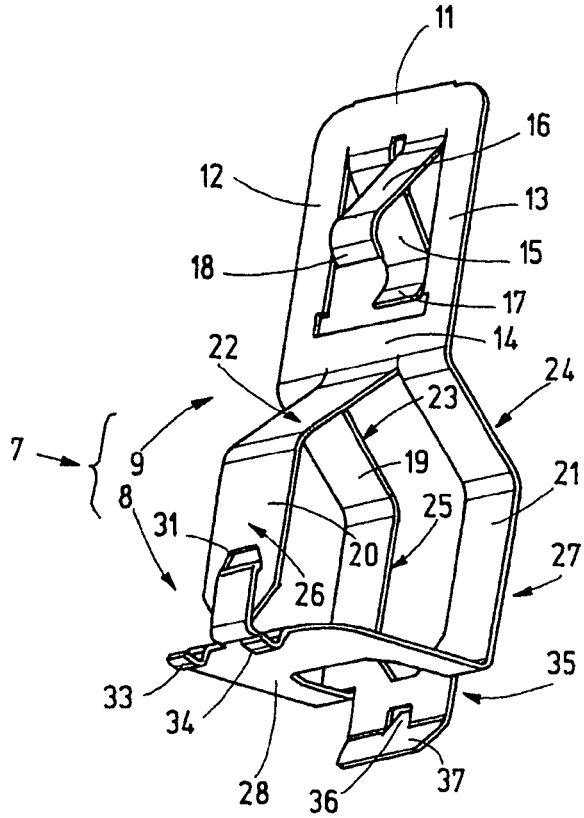
FIG. 2 is a perspective view of the retaining spring of FIG. 1.

The retaining spring 6 is shown separately in FIG. 2. It is preferably a one-piece element made of resilient metal, such as chromium-nickel steel. It can be produced in a stamping and bending process and can be directly produced in finished form in a suitable forming die or tool.

The retaining spring 6 has a spring body 7, which includes a fastening portion 8 and a bulb retainer portion 9. The bulb retainer portion 9 extends substantially perpendicular to the fastening portion 8, which, as FIG. 1 shows, is preferably located in the same plane as the lamp housing 2. The bulb retainer portion 9 includes a crosspiece 11 that is located distally from the fastening portion 8 and that is joined to a further crosspiece 14 via two outer legs 12, 13. The crosspieces 11, 14 and legs 12, 13 form a frame that surrounds two detent tongues 15, 16. The detent tongues 15, 16 are disposed between the legs 12, 13 and are retained at their ends on the crosspiece 11. As FIG. 1 shows, they preferably extend at an acute angle to one another, as well as at acute angles to the legs 12, 13. This is true both for the unstressed state of FIG. 2 and the operating state shown in FIG. 1. The detent tongues 15, 16 have been cut free from the surrounding frame in a stamping operation and thereafter are bent in different directions out of the plane defined by the frame. The ends of the detent tongues 15, 16 are bent at an angle toward one another. Angled portions 17, 18 embodied here serve the purpose of making contact with the arms 4, 5 of the fluorescent tube, as FIG. 1 shows.

From the crosspiece 14, connecting legs 19, 20, 21 extend toward the fastening portion 8. The connecting leg 20 located in the middle is preferably wider than the respective outer connecting legs 19, 21. While the outer connecting legs are bent to one side parallel to one another, the middle connecting leg 20 leads approximately at a right angle or an acute angle to them in the opposite direction. The parts of the legs 19, 20, 21 leading away from crosspiece 14 form abutments 22, 23, 24 for the arms 4, 5 of the discharge tube, as can be seen particularly from FIG. 1. The legs 19, 20, 21 furthermore each have a bend at some distance from the abutment regions, so that they form portions 25, 26, 27 that are parallel to one another. These portions may be considered to be a spring parallelogram. The portions 25, 26, 27 of the connecting legs 19, 20, 21 lead to opposing edges of a plate-like portion 28 that serves to support the retaining spring 6 on the lamp housing 2.

While the legs 19, 21 merge integrally with the portion 28 along a bending line, the leg 20 is joined to the portion 28 via a lock beaded connection. To that end, the portion 28 has a bent tab 29, which protrudes from the side of the portion 28 diametrically opposite the connecting legs 19, 21. Conversely, the connecting leg 20, has an opening 31 on its end adjacent the portion 28, through which extends one end of the tab 29 that is bent at an angle. This end is bent over on the inside of the leg 20, so that the end of the tab 29 forms a U-shaped eyelet. The leg 20 cannot escape from this eyelet. This is true regardless of whether this leg is capable of moving with play counter to the tab 29, or whether the tab has been pressed firmly together. The inner part of the tab 29 is longer than the opening 31, in terms of the longitudinal direction of the connecting leg.

For fastening the portion 28 to the lamp housing 2, in this embodiment there are employed two suspension hooks 33, 34, which have offset bends and extend away from one edge of the portion 28, and a detent protrusion 35 in the form of a tab with an angled detent tongue 36. The tab is preferably stamped out of the portion 28 and protrudes downwardly perpendicular to it. The free end 37, after the detent tongue 36 has been cut free, is preferably bent at an angle to the portion 28, so that the detent tongue 36 protrudes outwardly and away from the suspension hooks 33, 34.

The use of the retaining spring 6 is as follows: As FIG. 1 shows, this retaining spring can be secured to a fastening opening 38 of the lamp housing 2 in a simple way, by first inserting the suspension hooks 33, 34 into the fastening opening 38 and then swiveling the detent protrusion 35, in a swiveling motion of the retaining spring 6, into the fastening opening 38 until the detent tongue 36 engages the fastening opening 38 from behind. The retaining spring 6 is now completely installed.

The fluorescent bulb 3 can be solidly locked by its arms 4, 5 to the retaining spring 6 in detent fashion. To that end, the arms 4, 5 are slipped over the bulb retainer portion 9 until they snap into place between the leg 16 and the abutment 22, and between the leg 15 and the abutments 23, 24, respectively. In this state, the fluorescent bulb 3 is still axially displaceable. It can now be displaced axially, for instance, in order to insert its base into a suitable socket. In the same way, the fluorescent bulb 3 can be moved out of the socket for removal by being axially displaced. After that, it can be slipped off the retaining spring 6 by simply being moved vertically upwardly (in terms of FIG. 1) from the lamp housing 2. In the process, it overcomes the detent action of the detent spring tongues 15, 16.

FIG. 3 illustrates a modified embodiment of the retaining spring 6. For those portions that are the same as in the retaining spring 6 of FIGS. 1 and 2, the same reference numerals are used and reference is made here to the discussion appearing above.

The difference between the retaining spring 6 of FIG. 3 and the retaining spring described above resides in the way in which it is fastened to the lamp housing 2. Two detent protrusions 41, 42 are used for the fastening. They are disposed approximately centrally on the portion 28 and protrude perpendicularly away from it. Once the detent tongues 45, 46 have been cut free, their ends 43, 44 are bent toward one another, to facilitate inserting and snapping in the detent protrusions into pre-stamped openings in the lamp housing 2. The ends of the detent tongues 45, 46 can in turn be resiliently moved toward one another, in order if necessary to make it possible to pull the retaining spring 6 out of its fastening opening, or in other words to release the retaining spring 6.

Figure 4:
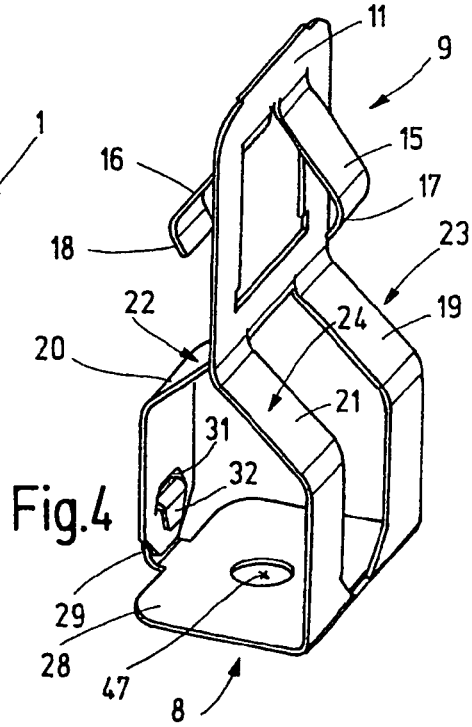
FIG. 4 is a perspective view of a further-modified embodiment of the retaining spring.

In the exemplary embodiments thus far discussed, detent protrusions 35, 41, 42, optionally in conjunction with suspension hooks 33, 34, have served as fastening means for the retaining spring 6. As FIG. 4 shows it is also possible to form a fastening opening 47 in the portion 28, for instance, in the middle, to act as a fastening means. In that case, screws, rivets or any other suitable means can be used for fastening. Otherwise, the above description of the retaining spring of FIGS. 1 and 2 applies accordingly.

Figure 5:
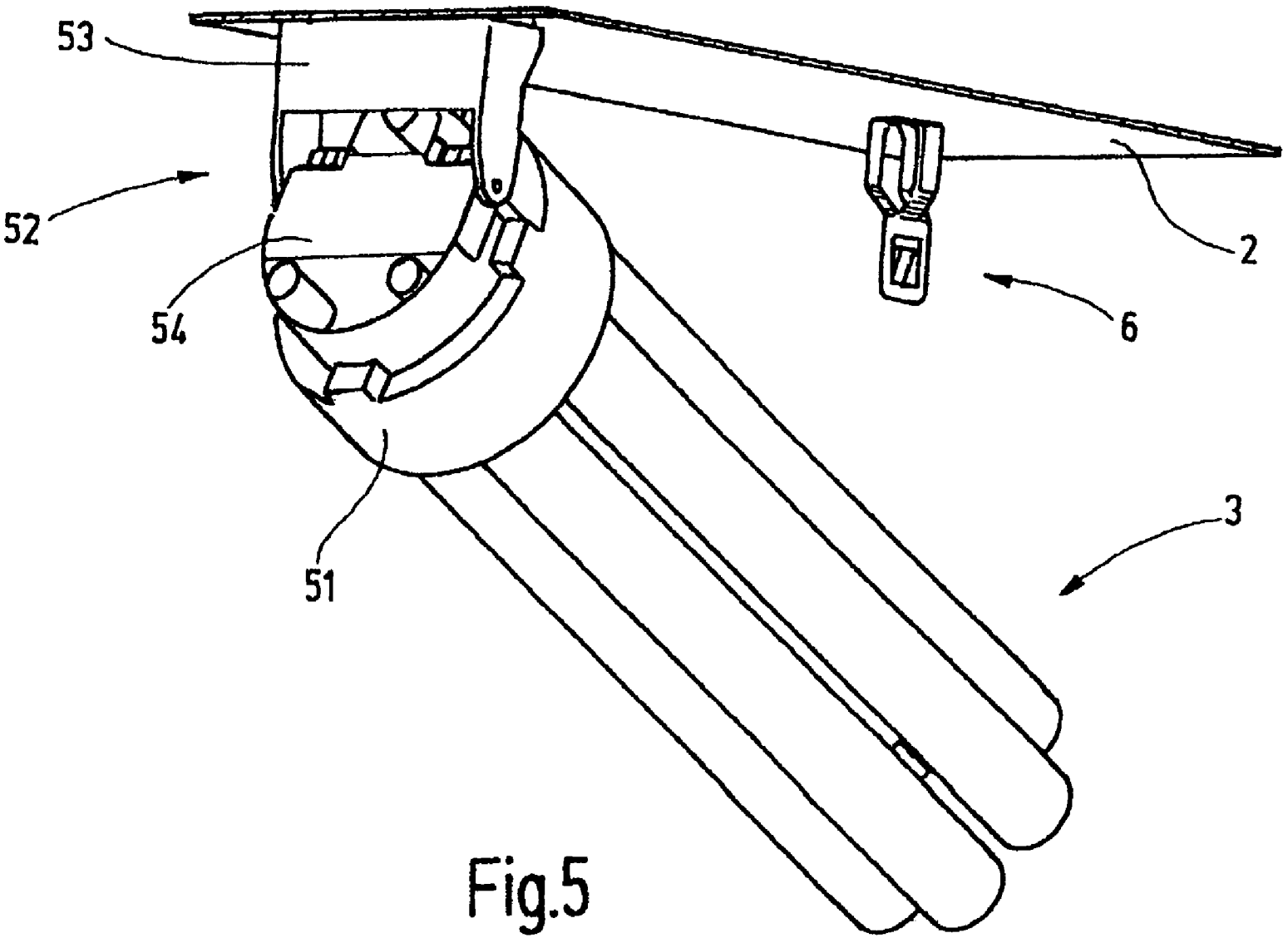
FIG. 5 is a perspective view showing the use of the retaining spring for retaining a multi-tube fluorescent bulb, in cooperation with a swiveling socket.

In FIG. 5, a modified embodiment of the fluorescent bulb 3 is shown. While FIG. 1 assumes a two- or four-tube fluorescent bulb, FIG. 5 illustrates a six- or eight-tube fluorescent bulb which is provided with a cap or base 51 on one end. This bulb base is retained in a bulb socket 52, which has both a horizontal portion 53 secured to the lamp housing 2 and a portion 54 pivotably supported on the horizontal portion. The bulb socket 52 thus has a hinge whose pivot axis extends transversely to the longitudinal direction of the fluorescent bulb 3. The retaining spring 6 is disposed spaced apart from the bulb socket 52 and is the same retaining spring as described above. The above description therefore applies accordingly. The retaining spring 6 is suitable for supporting the weight of the fluorescent bulb 3, to prevent the fluorescent bulb from swiveling downwardly. The detent action of the retaining spring 6 between respective tubes of the fluorescent bulb 3 assures an adequately firm seat. The retaining spring 6 is dimensioned such that it can be seated securely between the tubes of two-tube, four-tube, six-tube or eight-tube fluorescent bulbs. The embodiment of the bulb socket 52 and retaining spring 6 shown in FIG. 5 is suitable when space is tight for installing the lamp. The bulb may, however, also be disposed horizontally or vertically (in the latter case, standing on end, or suspended by an upper end).

A fluorescent bulb retaining spring is provided in particular for supporting and bearing the free end of a fluorescent bulb that has a base on one end. The retaining spring is preferably, embodied in one piece as a sheet-metal stamped and bent part, entirely and seamlessly comprising one and the same material. Its particular shaping makes manifold usage possible as well as clean support of the fluorescent bulb while permitting axial displaceability thereof. Moreover, the retaining spring can be produced especially simply from one piece of sheet metal of substantially uniform thickness and with a rectangular outline. All the functional parts and functional regions are created by cutting out spring tongues and bending them outwardly from the sheet. Connecting legs between a bulb retainer portion, associated with the fluorescent bulb, and a fastening portion form an annular region which is closed in force-locking fashion by a crimped connection. The crimped or lock beaded connection is preferably produced in automated fashion as part of a stamping and bending operation.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A fluorescent bulb retaining spring suitable for supporting a tube portion of a fluorescent bulb that has a base at one end, comprising: a spring body formed integrally of resilient metal and including:

a) a base member that comprises a fastening mechanism for attaching the retaining spring to a surface; and b) a bulb retainer portion comprising two detent spring tongues and an associated abutment member for each detent spring tongue, wherein each abutment member comprises an inclined portion carried by an upstanding leg connecting the base member to the bulb retainer portion, wherein the two upstanding legs with their respective abutment members and the base member form a substantially annular configuration, and wherein at least one of the upstanding legs is integrally connected on one side of the base member and a second upstanding leg is connected by a lock beaded connection on the diametrically opposite side of the base member.

2. A fluorescent bulb retaining spring according to claim 1, wherein the bulb retainer portion comprises a flat crosspiece, whose face is oriented substantially perpendicular to the base member and from which the two detent spring tongues extend toward the base member at acute angles to one another.

3. A fluorescent bulb retaining spring according to claim 2, wherein the two detent spring tongues are bent outwardly to opposing sides of the bulb retainer portion.

4. A fluorescent bulb retaining spring according to claim 2, wherein the two detent spring tongues are disposed between two legs that support the crosspiece.

5. A fluorescent bulb retaining spring according to claim 1, wherein the at least one detent spring tongue comprises on its end a portion bent at an angle that serves to support the fluorescent bulb.

6. A fluorescent bulb retaining spring according to claim 1, wherein the upstanding legs are connected to the base member on two diametrically opposite sides of the base member.

7. A fluorescent bulb retaining spring according to claim 1, wherein the base member has a flat plate-like portion.

8. A fluorescent bulb retaining spring according to claim 7, further comprising tabs that extend away from the plate-like portion and form detent protrusions for attaching the retaining spring to the surface.

9. A fluorescent bulb retaining spring according to claim 7, further comprising suspension hooks embodied on one side of the base member and a detent protrusion embodied on the diametrically opposite side of the base member, wherein the suspension hooks and the detent protrusion comprise a device for attaching the retaining spring to the surface.

10. A fluorescent bulb retaining spring according to claim 7, wherein at least one fastening opening is embodied on the base member.

11. A fluorescent bulb retaining spring according to claim 1, wherein the substantially annular configuration has a substantially polygonal shape.

12. A fluorescent bulb retaining spring according to claim 11, wherein the substantially polygonal shape comprises five sides.

13. A fluorescent bulb retaining spring according to claim 11, wherein the substantially polygonal shape is such as to provide an amount of lateral resilience sufficient to compensate for tolerances and to minimize lateral forces exerted by the retaining spring on the fluorescent bulb.

14. A fluorescent bulb retaining spring according to claim 11, wherein the substantially polygonal shape comprises two essentially parallel sides that permit the shape to act like a parallelogram.

15. A fluorescent bulb retaining spring according to claim 1, wherein the surface in which the fluorescent bulb retaining spring is attached is part of a lamp housing and the tube portion of the fluorescent bulb are two glass tubes of the fluorescent bulb.

16. A fluorescent bulb retaining spring according to claim 1, wherein the two upstanding legs are orientated substantially parallel with each other.

17. A fluorescent bulb retaining spring according to claim 1, wherein the two upstanding legs are orientated substantially perpendicular to a flat plate-like portion of the base member.

18. A fluorescent bulb retaining spring according to claim 1, wherein the bulb retainer portion comprises a flat cross-piece, whose face is oriented substantially parallel to the longitudinal direction of the two upstanding legs.

19. A method for forming a bulb retaining spring, suitable for supporting a tube portion of a fluorescent bulb that has a base at one end, comprising:

providing a generally rectangular sheet of metal, and subjecting the metal sheet to a stamping and bending process to form said bulb retaining spring, wherein the formed bulb retaining spring comprises a spring body formed integrally of resilient metal and including (a) a base member that comprises a fastening mechanism for attaching the retaining spring to a surface; and (b) a bulb retainer portion comprising two detent spring tongues and an associated abutment member for each detent spring tongue, wherein each abutment member comprises an inclined portion carried by an upstanding leg connecting the base member to the bulb retainer portion, and wherein the two upstanding legs with their respective abutment members and the base member form a substantially annular configuration.

20. A method for forming a bulb retaining spring according to claim 19, wherein the surface in which the fluorescent bulb retaining spring is attached is part of a lamp housing and the tube portion of the fluorescent bulb are two glass tubes of the fluorescent bulb.

* * * * *